United States Patent [19]

Williams et al.

[11] Patent Number: 4,975,087

[45] Date of Patent: Dec. 4, 1990

[54] TELECOMMUNICATION BANTAM JACK MODULE

[75] Inventors: Wayne E. Williams; Richard S. Garrett; Victor Lenoir, all of Spokane, Wash.

[73] Assignee: Telect, Inc., Spokane, Wash.

[21] Appl. No.: 452,813

[22] Filed: Dec. 18, 1989

[51] Int. Cl.[5] ..... H01R 17/18

[52] U.S. Cl. ..... 439/668; 439/540

[58] Field of Search ..... 439/668, 669, 684, 714, 439/188, 675, 540

[56] References Cited

U.S. PATENT DOCUMENTS 3,784,962 1/1974 Byrd ..... 439/668

*Primary Examiner*—David L. Pirlot

*Attorney, Agent, or Firm*—Wells, St. John & Roberts

[57] ABSTRACT

A telecommunication bantam jack module (10) is illustrated in FIGS. 6–8 for mounting on a standard length 19″ or 23″ shelf as illustrated in FIGS. 10 and 11 to connect with 64 or 84 circuits respectively. Each module preferably contains four bantam jack assemblies or multiples of four. Each bantam jack assembly (86) includes a jack frame (88) having a width less than 0.250 inches and preferably approximately 0.225 inches. Jack frame (88) has an output sleeve (94), an input sleeve (96) and a monitor sleeve (98). Each of the sleeves has a reduced wall thickness in the horizontal direction at the center line in which the thickness is approximately 0.215 inches. The reduced thickness is approximately 0.019–0.02 inches. In the preferred embodiment, the sleeves (94), (96) and (98) have flats (102) formed on the sides thereof to form the reduced cross section.

11 Claims, 6 Drawing Sheets

FIG 1
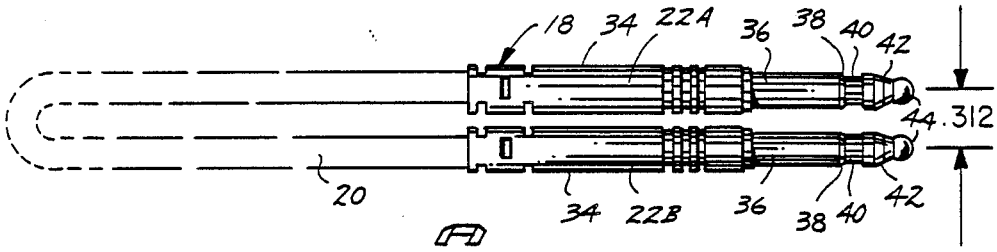
A
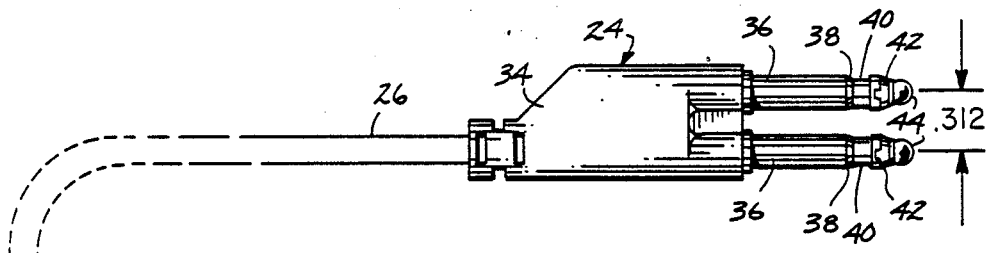
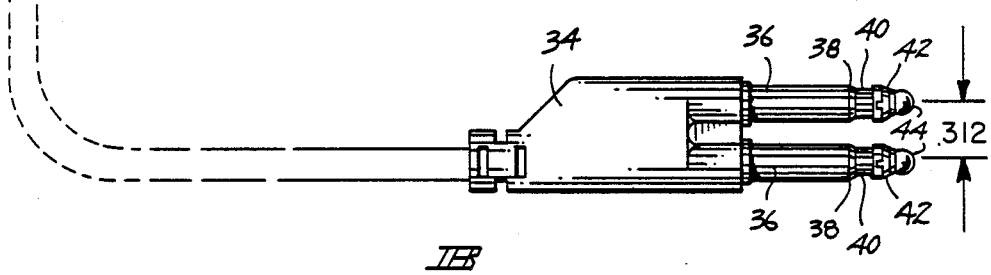
B
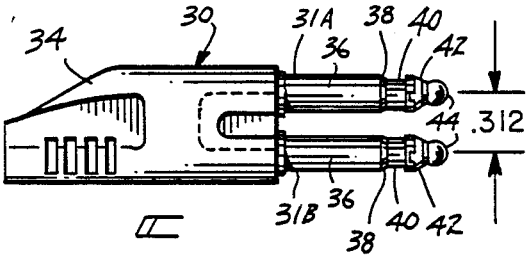
C
PRIOR ART

TELECOMMUNICATION BANTAM JACK MODULE

TECHNICAL FIELD

The invention relates to telecommunication bantam jack modules that are mountable on standard length telecommunication shelves in a telecommunication facility such as a telephone central office.

BACKGROUND OF THE INVENTION

Conventional telecommunication bantam jack modules are presently available for mounting on standard length horizontal shelves of 19" and 23" of a multi-shelf telecommunication rack. Such telecommunication bantam jack modules, generally designated with the numeral 46, are illustrated in FIGS. 2, 4–5 and 9 for mounting on standard length horizontal 19" shelf 12 or standard length horizontal 23" shelf 14. Such shelves 12, 14 are mounted on a multi-shelf telecommunication rack 16.

The prior art bantam modules 46 are designed to receive the bantam plugs illustrated in FIG. 1. Specifically the modules 46 are intended to receive the bantam plugs of (1) standard single plug bantam batch cord 18, (2) standard dual plug bantam batch cords 24, and (3) standard looping bantam plug assemblies 30.

Specifically a standard single plug bantam batch cord 18 has a single twisted pair or coaxial conductor cable 20 with single bantam plug assemblies 22A and 22B mounted on opposite ends with mini-bantam jack plugs insertable into the bantam jack module.

The standard dual plug bantam patch cord 24 includes a dual twisted pair or coaxial conductor cable 26 with dual bantam plug assemblies 28A and 28B mounted at opposite ends. Each of the plug assemblies 28A and 28B have dual, parallel, mini-bantam jack plugs that are spaced approximately 0.312 inches on center. The standard looping bantam plug assembly 30 has dual, parallel, mini-bantam jack plugs 31A and 31B mounted parallel with each other with a center-to-center spacing of 0.312 for inserting into the bantam jack module.

As illustrated more specifically in FIG. 1A–C, each mini-bantam jack plug has a nonconductive gripping section 34 with an outer conductive barrel or sleeve 36 that forms a system ground for the twisted pair or coaxial cable. A standard mini-bantam plug sleeve has a exterior diameter of approximately 0.175 inches. Each mini-bantam plug includes an outer nonconductive section 38. Further, each plug 32 includes a conductive ring 40 that is electrically connected to one of the conductors of the cables. Additionally each plug includes an inner nonconductive section 42 that insulates the conductive ring 40 from a conductive tip 44. The conductive tip 44 is electrically connected to the conductor of the cables.

With this background, the prior art mini-bantam jack module 46, illustrated in FIGS. 2–5 and 9, will be more specifically described. The module 46 includes a front panel 48 that has a number of vertical columns 50 of aperatures that are spaced in a horizontal direction of approximately 0.312 inches. The front panel 48 of the prior art bantam module 46 illustrated in FIG. 2 is designed to receive four jack assemblies in which the overall width of the front panel 48 is 1.250 inches. The module 46, illustrated in FIGS. 2–5 and 9, includes four bantam jack assemblies 53. Each assembly 53 includes a frame 55 that has an input sleeve 57 formed integrally therewith that extends outward through an aperture in one of the columns 50 of the front panel 48. Additionally each frame has a output sleeve 59 that likewise extends through one of the apertures in the same column 50 of the front panel 48. Additionally each frame 55 includes a monitor sleeve 61 that projects outward through one of the apertures of the front panel 48. Each of the sleeves 57, 59 and 61 has an internal diameter that is complementary for receiving the barrel or sleeve 36 of the bantam plug. Generally the internal diameter is 0.177 inches to form a frictional contact between the internal surfaces of the sleeves 57, 59 and 61 and the outer barrel or sleeve 36 of the mini-bantam plugs. Additionally the conventional sleeves 57, 59 and 61 have a uniform cylindrical outer surface having a diameter of approximately 0.257 inches.

It should be specifically noted that the center-to-center spacing between the input sleeve 57 and the output sleeve 59 of each of the frames 55 is uniform and is approximately 0.312 inches. Consequently, the dual bantam plugs 28 and 33 may be inserted in a vertical orientation between the input sleeve 57 and the output sleeve 59 of the same frame as illustrated in FIG. 5 or the dual bantam plug 28 and the looping bantam plug 30 may be oriented horizontally and inserted into adjacent input sleeves 57 or between adjacent output sleeves 59 of adjacent frames. In other words the plugs may be vertically oriented or horizontally oriented as the vertical orientation between the input sleeve 57 and the output sleeve 59 is the same as the distance between adjacent input sleeves 57 and adjacent output sleeves 59.

The spacing between the input sleeve 57 and the monitor sleeve 61 is somewhat greater with the monitor sleeve generally receiving a single plug of a standard three conductor bantam pathc cord 18. The monitor sleeve 61 is utilized to monitor the digital communication signals being transmitted through the bantam jack assembly without interrupting their transmission.

Each bantam jack assembly 53 further includes an input switch assembly 63, an output switch assembly 65 and a monitor switch assembly 67 that are illustrated in FIGS. 4 and 5. Each of the switch assemblies 63, 65, and 67 include a leaf spring ring contact 69 and a leaf spring tip contact 71 for making electrical contact with the corresponding conductors of the bantam plugs. Such electric contacts are illustrated in FIG. 5 in which a standard looping bantam plug 30 is inserted into the input sleeve 57 and the output sleeve 59.

As illustrated in FIG. 9, the prior art modules 46 may be mounted on a standard length horizontal 19" shelf 12 in which there are fifty-six circuits (jacks) on shelf 12A and eight circuits (jacks) on the lower shelf 12B. Consequently each shelf can only receive a maximum of fifty-six circuits. This means that for a system that is intended to interconnect sixty-four circuits, at least eight circuits must be positioned on the lower shelf 12B.

One of the principal objectives of this invention is to provide a telecommunication mini-bantam jack module that is able to accept standard mini-bantam plugs as illustrated in FIG. 1 while at the same time being able to mount sixty-four circuits on a standard 19" shelf and eighty-four circuits on a standard 23" shelf.

These and other objects and advantages of this invention will become apparent upon reading the following detailed description of a preferred embodiment.

BRIEF DESCRIPTION OF THE DRAWINGS

Prior art telecommunication bantam jack modules and a preferred embodiment of the present invention are illustrated in the accompanying drawings, in which:

FIGS. 1A–C illustrate standard mini-bantam pathc cords and plugs of a conventional nature that are utilized with the subject invention;

FIG. 9 is a frontal view of a section of a multi-shelf telecommunication rack illustrating two 19" horizontal shelves receiving the prior art mini-bantam jack modules on both an upper shelf and a lower shelf;

FIG. 10 is a frontal fragmentary view of a multi-shelf telecommunication rack illustrating sixteen adjacent modules of the preferred embodiments mounted adjacent to each other on a single 19" horizontal shelf.

DETAILED DESCRIPTION OF THE PREFERRED EMBODIMENTS

Figure 2:
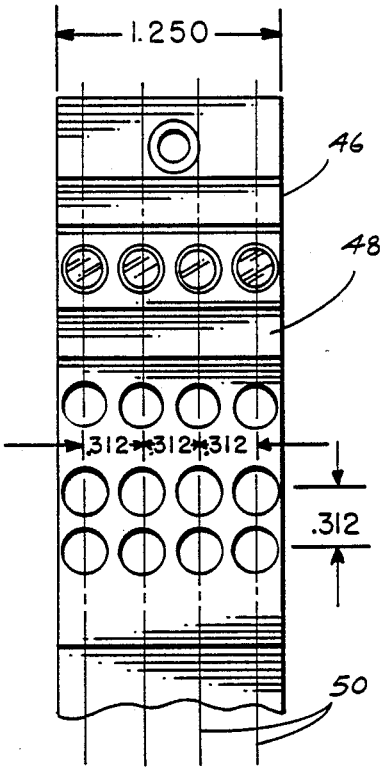
PRIOR ART FIG 2
FIG. 2 is a fragmentary front view of the front panel of a prior art mini-bantam jack module.
Figure 3:
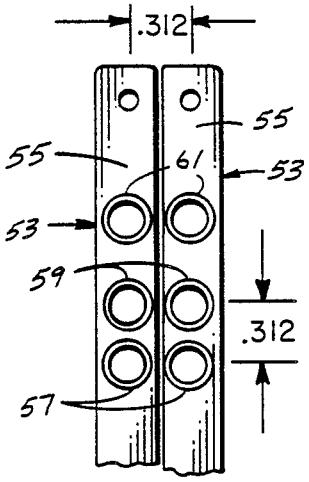
PRIOR ART FIG 3
FIG. 3 is a fragmentary front view of two conventional jack frames for receiving the miniature bantam jack plugs illustrated in FIG. 1.
Figure 4:
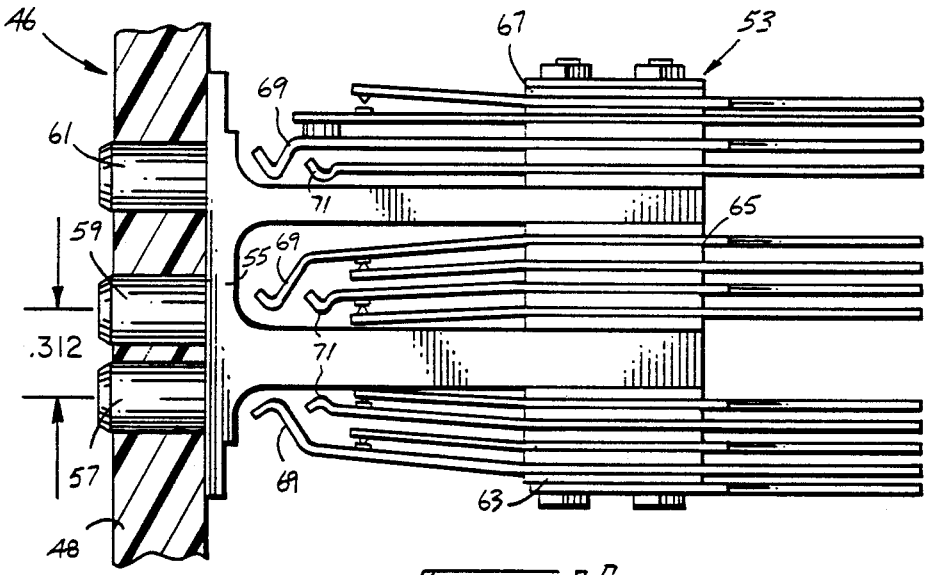
FIG. 4 is a fragmentary side view of the prior art bantam jack modules illustrated in FIGS. 2 and 3.
Figure 5:
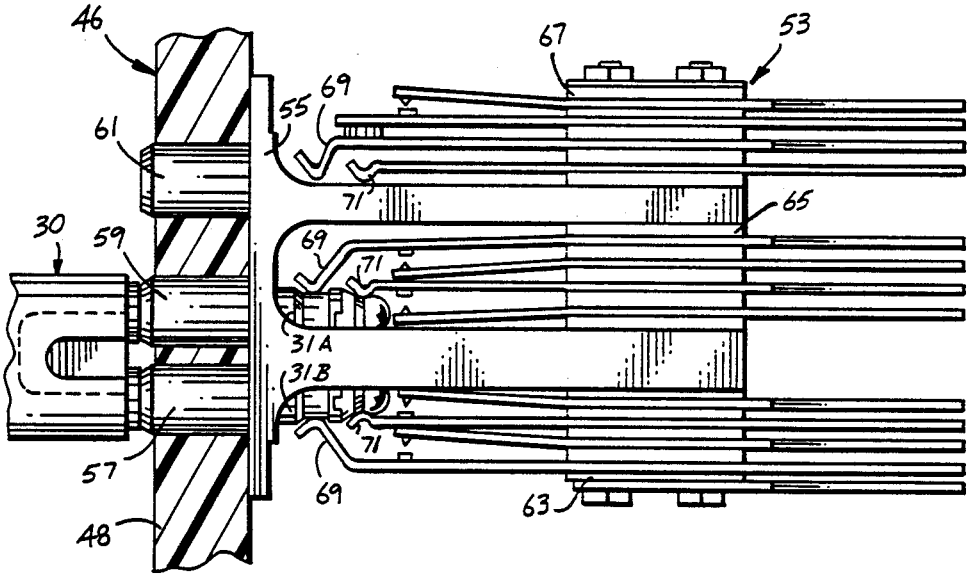
FIG. 5 is a fragmentary side elevational view similar to FIG. 4 except showing a standard looping mini-bantam plug inserted into the module.

The following disclosure of the invention is submitted in furtherance with the constitutional purpose of the Patent Laws "to promote the progress of science and useful arts" (Article 1, Section 8).

A preferred embodiment of this invention is represented by the telecommunication bantam jack module generally designated with the numeral 10 that is illustrated in FIGS. 6–8 and 10–11. The telecommunication bantam jack module 10 includes a housing having a vertically elongated front panel 82 with a plurality of vertical columns 84 of apertures. A module 10 having a multiple of four jack assemblies 86 is most desireable in which the jack frames are mounted at 0.250 inches intervals. A module 10 having four bantam jack assemblies 86 is the basic building block. Such a module has a front panel 82 having a width of approximately one inch. Alternatively, a module 10 having eight bantam jack assemblies 86 or a module 10 having sixteen bantam jack assemblies 86 may also be used. A module 10 having eight bantam jack assemblies would have a front panel having a width of two inches and the module 10 having sixteen bantam jack assemblies would have a width of approximately four inches. A module 10 of thirty-two bantam jack assemblies 86 is acceptable although it does not have the flexibility of the more fundamental building block modules of four, eight, or sixteen bantam jack assemblies 86.

Figures 6, 7, 8, 11:
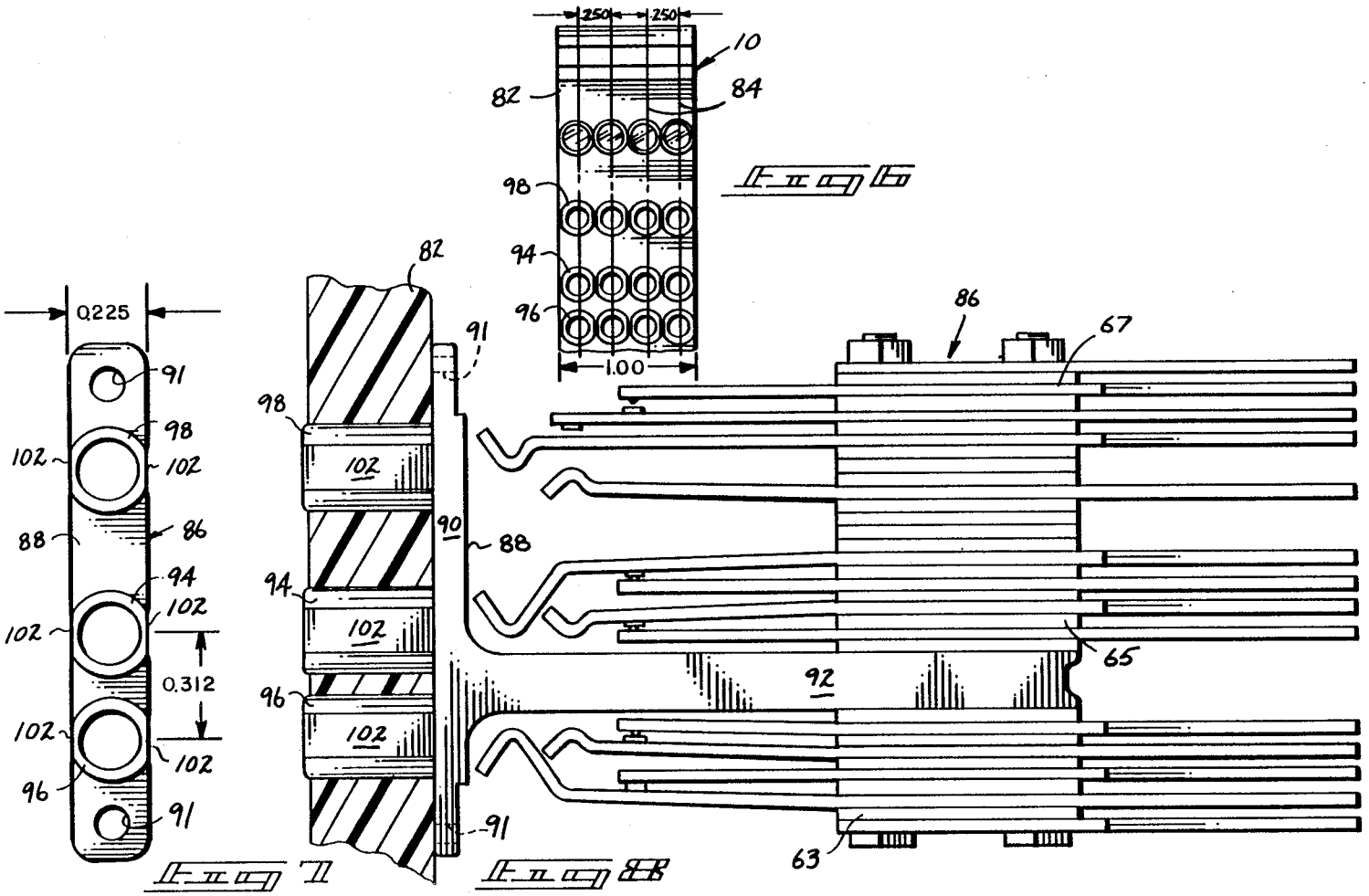
FIG. 6 is a fragmentary front view of a telecommunication mini-bantam jack module of the preferred embodiment of this invention.
FIG. 7 is a front view of a jack frame of the preferred embodiment of this invention.
FIG. 8 is a side elevational view of the preferred embodiment of this invention.
FIG. 11 is a fragmental frontal view of a multi-shelf telecommunication rack illustration twenty-one modules of the preferred embodiment mounted on a single 23" horizontal shelf.
Figure 5:
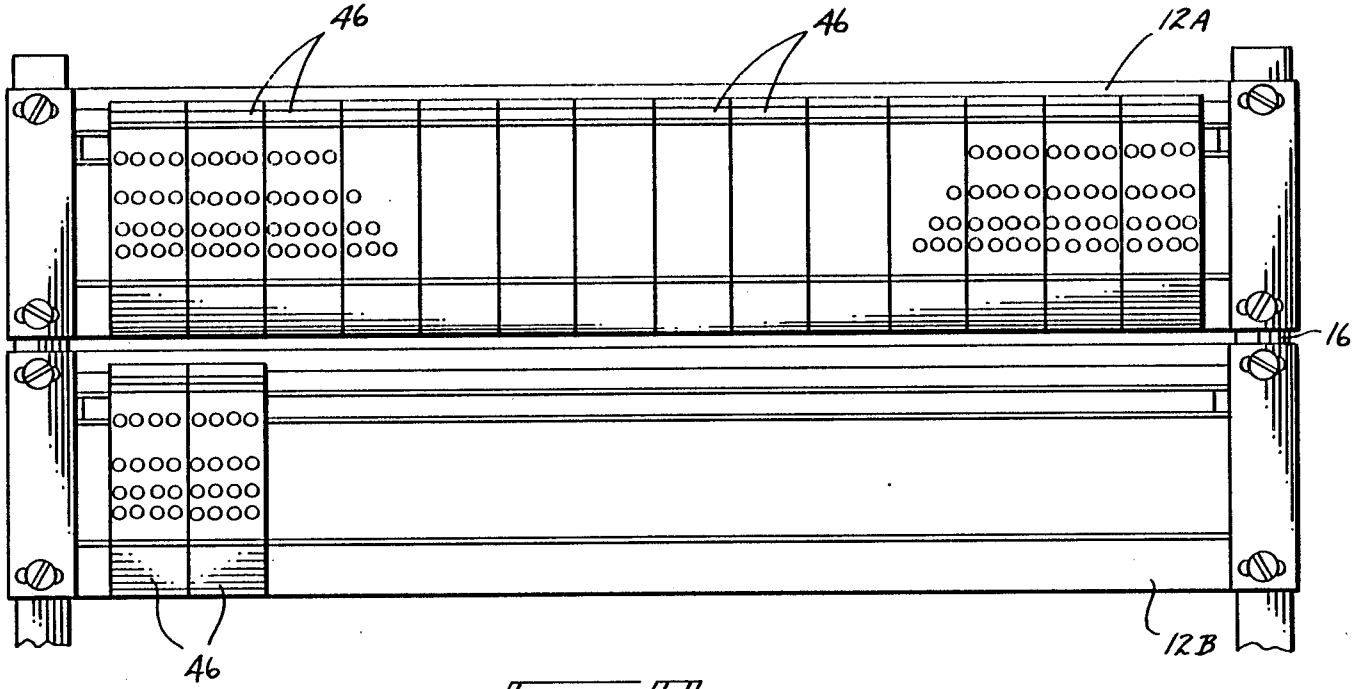
FIG. 5 PRIOR ART
Figure 11:
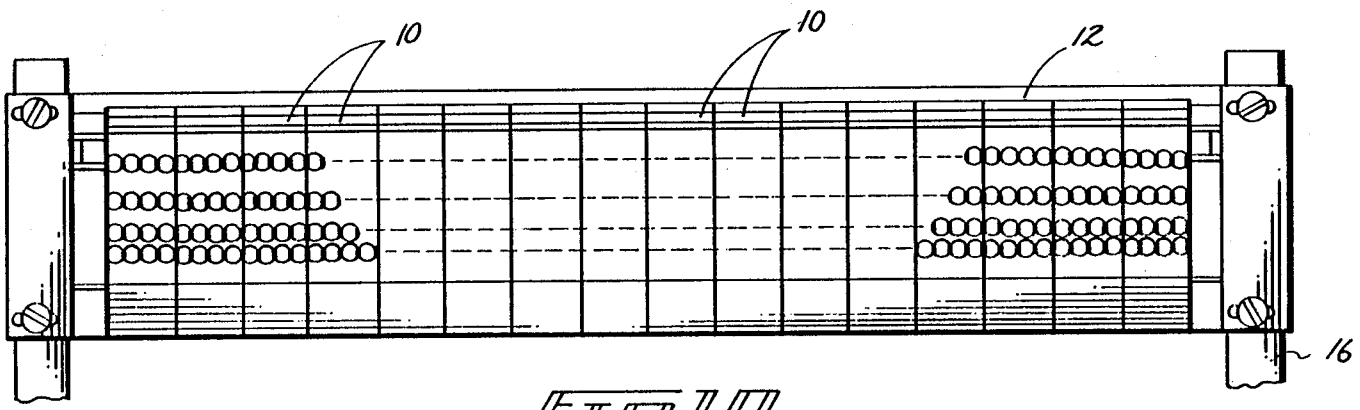
Figure 11:
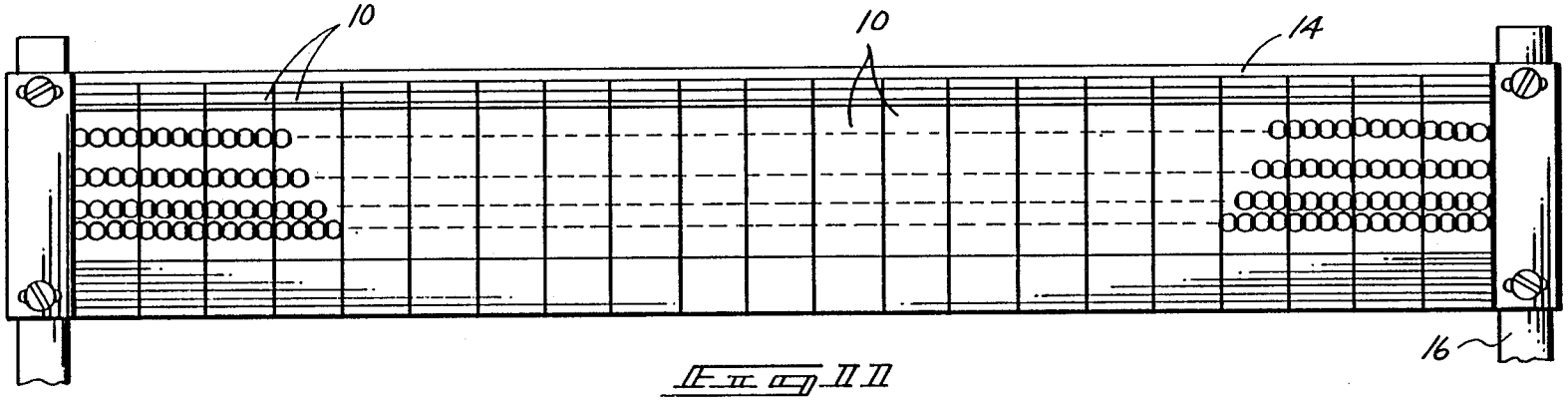

Each of the bantam jack assemblies 86 includes a jack frame 88, illustrated more specifically in FIGS. 7 and 8. Each jack frame 88 includes an integral elongated front plate 90 having mounting apertures 91 at the vertical ends for attaching the jack frame 88 to the front panel 82. Each jack frame 88 includes at least one switch support beam 92 that extends rearward at substantially right angle to the front plate 90 for supporting standard switch assemblies 63, 65 and 67. The beam 92 may be a twin or tri-beam configuration shown and described in Warner U.S. Pat. No. 4,861,281 granted Aug. 29, 1989. Each jack frame 88 further includes an output sleeve 94, an input sleeve 96 and a monitor sleeve 98 that extend outward from the front plate 90 projecting through the column apertures illustrated in FIG. 6 and 8.

The output sleeve 94, the input sleeve 96 and the monitor sleeve 98 are designed to receive the standard mini-bantam plugs. It should be noted that the vertical center-to-center distance between the output sleeve 94 and the input sleeve 96 of each jack frame 88 is a standard distance of 0.312 inches to accommodate the miniature bantam plugs illustrated in the various configurations in FIG. 1.

Each of the sleeves 94, 96 and 98 have an internal diameter complementary to receive the plugs in which the barrel or sleeve 36 has an external diameter of 0.175 inches. Preferably the internal diameter of the sleeves 94, 96 and 98 is approximately 0.177 to provide a frictional fit with the plug barrels 36.

A very important aspect of this invention is that the wall thickness of the output sleeves 94, 96 and 98 is less than 0.25 thickness in the horizontal direction (transverse to the longitudinal direction of the front plate 90). In the preferred embodiment, the sleeves 94, 96 and 98 have varying wall thicknesses about their circumferences, in which the thickness in the horizontal direction is reduced at the center line to approximately 0.019–0.020 inches. Preferably the outer diameter in the horizontal direction at the center line is approximately 0.215 inches with the diameter in the vertical direction through the center line being the conventional 0.257 inches. In the configuration illustrated in the drawings, the reduced wall thickness of the sleeves 94, 96 and 98 forms a flat 102 with the distance between the flats 102 of each sleeve being approximately 0.215 inches. Alternatively, the wall thicknesses of the sleeves 94, 96, and 98 may be uniform at approximately 0.019–0.020 inches with the sleeves having a uniform outer diameter of approximately 0.215 inches.

Additionally the width of each of the jack frames 88 as illustrated in FIG. 7 is less than 0.25 inches and preferably approximately 0.225 inches.

The advantages of the applicant's invention are dramatically illustrated in FIGS. 10 and 11. In FIG. 10, a standard length horizontal 19" shelf 12 is illustrated having sixteen modules 10 that contain four jack assemblies 86 each, for a total of sixty-four jacks and circuits mounted thereon. This is a comparison to the prior art module illustrated in FIG. 9 in which only fourteen modules 46 can be mounted on one 19" shelf; with two additional modules 46 mounted on the second 19" shelf to service the same equipment that is serviced by the applicant's invention by the modules being mounted on the one shelf.

FIG. 11 illustrates the modules 10 being mounted on a standard length horizontal 23" shelf. Twenty-one modules are mounted on the single shelf to service eighty-four circuits.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A telecommunication bantam jack module for mounting in a standard length horizontal shelf of a multi-shelf telecommunication terminal rack and receiving (1) standard single conductor patch cords having single mini-bantam plugs on opposite ends thereof, (2) standard dual conductor patch cords having combined parallel mini-bantam plugs on opposite ends thereof, and (3) standard bantam looping plugs having combined parallel mini-bantam plugs; in which each of the mini-bantam plugs has a standard preset diameter and a standard preset center-to-center distance between combined parallel bantam plugs, wherein the bantam jack module comprises:

a housing having a vertically elongated front panel with a plurality of side-by-side columns of vertical spaced apertures;

a plurality of vertically oriented bantam jacks mounted side-by-side in the housing;

each of said bantam jacks having:

(1) a jack frame with an elongated jack face plate extending between upper and lower mounting ends that securely mount the bantam jacks to the front panel and a switch support beam extending rearward of the sleeve section;

(2) an input jack sleeve formed integrally with the face plate and extending through one of the front panel apertures and having an internal diameter complementary with the preset diameter of the bantam plugs for receiving a bantam plug therein;

(3) an output jack sleeve formed integrally with the face plate and parallel with the input jack sleeve and extending through one of the front panel apertures and having an internal diameter complementary with the preset diameter of the bantam plugs for receiving a bantam plug therein;

(4) wherein the center-to-center vertical distance between the input sleeve and the output sleeve is complementary to the preset center-to-center distance between the combined parallel plugs;

(5) a plurality of jack switch assemblies mounted on the support beam in which at least one jack switch assembly is aligned with the input sleeve to electrically connect with a bantam plug receive in the input sleeve and in which at least another jack switch assembly is aligned with the output sleeve to electrically connect with a bantam plug receive in the output sleeve;

wherein the width of the jack frames and the horizontal center-to-center distance between laterally adjacent input and output sleeves is less than the preset vertical center-to-center distance between the input and output sleeves of the same jack so that the bantam plugs may be inserted in the vertical orientation into the input sleeve and the output sleeve of the same jack, but is prevented from being inserted in the horizontal orientation into input sleeves or output sleeves of adjacent bantam jacks of the module because the horizontal center-to-center distance between the adjacent input sleeves and output sleeves is less than the standard preset center-to-center distance between the bantam plugs.

2. The telecommunication bantam jack module as defined in claim 1 wherein the front panel of the housing has a width of one inch or less.

3. The telecommunication bantam jack module as defined in claim 1 wherein the center-to-center distance between adjacent input sleeves and between adjacent output sleeves is one-quarter of an inch or less.

4. The telecommunication bantam jack module as defined in claim 1 wherein each of the input sleeves and output sleeves have a uniform inner diameter and a non-uniform outer diameter in which the outer diameter in the horizontal direction is less than in the vertical direction.

5. The telecommunication bantam jack module as defined in claim 1 wherein each of the input sleeves and output sleeves have a maximum outer diameter and wherein the width of the jack frame is less than the maximum outer diameter of the sleeves.

6. The telecommunication bantam jack module as defined in claim 1 wherein the module has a multiple of four bantam jacks.

7. The telecommunication bantam jack module as defined in claim 1 wherein the shelf has a standard length of twenty-three inches and wherein multiple modules are mountable on the shelf containing a minimum of eighty-four bantam jacks.

8. The telecommunication bantam jack module as defined in claim 1 wherein the shelf has a standard length of nineteen inches and wherein multiple modules are mountable on the shelf containing a minimum of sixty-four bantam jacks.

9. The telecommunication bantam jack module as defined in claim 1 wherein each of the input sleeves and output sleeves have a thinner wall in the horizontal direction than in the vertical direction.

10. The telecommunication bantam jack module as defined in claim 9 wherein each of the input sleeves and the output sleeves have side flats forming reduced wall thicknesses in the horizontal direction to permit the jacks to be mounted closer to each other.

11. The telecommunication bantam jack module as defined in claim 9 wherein the center-to-center distance between adjacent input sleeves is 0.250 inches and the center-to-center distance between the input sleeve and the output sleeve of the same bantam jack is 0.312 inches and wherein the distance between combined parallel bantam plugs is 0.312. is 0.312.

* * * * *